US005121587A

United States Patent [19]

Zanini et al.

[11] Patent Number: 5,121,587

[45] Date of Patent: Jun. 16, 1992

[54] APPARATUS FOR APPLYING CLOSURES TO CONTAINERS

[75] Inventors: Gianpietro Zanini, Montanara; Carlo Corniani, Marmirolo, both of Italy

[73] Assignee: Azionaria Costruzioni Macchine Automatiche A.C.M.A. S.p.A., Bologna, Italy

[21] Appl. No.: 783,599

[22] Filed: Oct. 28, 1991

[30] Foreign Application Priority Data

Oct. 31, 1990 [IT] Italy ..... 3716 A/90

[51] Int. Cl.[5] ..... B67B 3/20; B65B 7/28

[52] U.S. Cl. ..... 53/367; 53/306

[58] Field of Search ..... 53/367, 306, 308, 317, 53/331.5, 287, 281, 282

[56] References Cited

U.S. PATENT DOCUMENTS

| | | | |
|---|---|---|---|
| 3,882,660 | 5/1975 | Sterling | 53/308 |
| 3,955,341 | 5/1976 | Wilhere | 53/367 X |
| 4,018,026 | 4/1977 | Kamisaka | 53/367 X |
| 4,506,489 | 3/1985 | Schieser et al. | 53/306 X |
| 4,559,759 | 12/1985 | Herbert | 53/308 |

FOREIGN PATENT DOCUMENTS

| | | | |
|---|---|---|---|
| 2238490 | 2/1973 | Fed. Rep. of Germany | 53/367 |

*Primary Examiner*—Horace M. Culver

*Attorney, Agent, or Firm*—Guido Modiano; Albert Josif

[57] ABSTRACT

The apparatus for applying closures to containers having a mouth which is inclined with respect to an axis of the containers, comprises a first conveyor and a second conveyor which are suitable for transferring in succession containers, which are arranged so that their axes are vertical. A closure application conveyor receives the containers from the first conveyor and transfers them to the second conveyor; the closure application conveyor has a clamp for gripping the containers which can oscillate between two positions, at which the axes of the related containers and, respectively, the axes of the mouths of the containers are arranged substantially vertical. The closure application conveyor has a closure application head for applying the closures to the containers while the axes of the mouths of the containers are arranged vertically.

2 Claims, 2 Drawing Sheets

III
III

APPARATUS FOR APPLYING CLOSURES TO CONTAINERS

BACKGROUND OF THE INVENTION

The present invention relates to an apparatus for applying closures to containers.

In particular, the present invention relates to an apparatus for applying closures to containers, such as bottles, flasks and the like, the neck whereof is inclined with respect to a vertical longitudinal axis of said containers.

In known apparatuses for applying closures to containers having an inclined neck, the containers, arriving from a filling unit which has filled them with liquid or powder-like substances, are fed in succession, in a vertical arrangement, to grip elements belonging to a rotating input carousel.

During their permanence on said carousel, the containers are rotated by the related grip elements so that they become arranged with their neck arranged vertically. This arrangement in fact facilitates the subsequent closure application operation, which occurs on another rotating closure-fitting carousel.

Due to compulsory layout requirements of the apparatuses at issue, said input carousel must have very small dimensions, and the described rotation of the containers occurs while said containers, supported by the grip elements, move along a rather small arc, for example equal to 45°. A consequence of this is the fact that said rotation of the containers is performed in a very rapid manner, and this fact often gives rise to an escape of liquid from said containers.

The transfer of containers which are inclined with respect to the vertical from the input carousel to the closure application carousel is furthermore much more difficult than the transfer of vertically arranged containers, and the elements involved in this transfer are unavoidably very complicated.

SUMMARY OF THE INVENTION

The aim of the present invention is to provide an apparatus which is suitable for applying closures to containers having a neck which is inclined with respect to respective axes of said containers, which does not have the disadvantages described with reference to the known art.

According to the present invention, an apparatus for applying closures to containers which have an inclined mouth with respect to an axis of said containers is provided, and comprises first and second conveyance means for the transfer in succession of said containers arranged so that said axes thereof are vertical, and a closure application conveyor which is suitable for receiving said containers from said first conveyance means and for transferring them to said second conveyance means; said closure application conveyor comprising means for gripping the containers which arrive from said first conveyance means and actuation means which are adapted for imparting to said grip means an oscillation in both directions between a first position and a second position at which said axes of the related containers and, respectively, the axes of the mouths of said containers are arranged substantially vertical; the closure application conveyor comprising closure application means which are suitable for applying to said containers said related closures while the axes of the mouths of said containers are arranged substantially vertical.

BRIEF DESCRIPTION OF THE DRAWINGS

The present invention will now be described with reference to the accompanying drawings, which illustrate a non-limitative example of embodiment thereof, wherein.

DESCRIPTION OF THE PREFERRED EMBODIMENTS

Figures 1, 2:
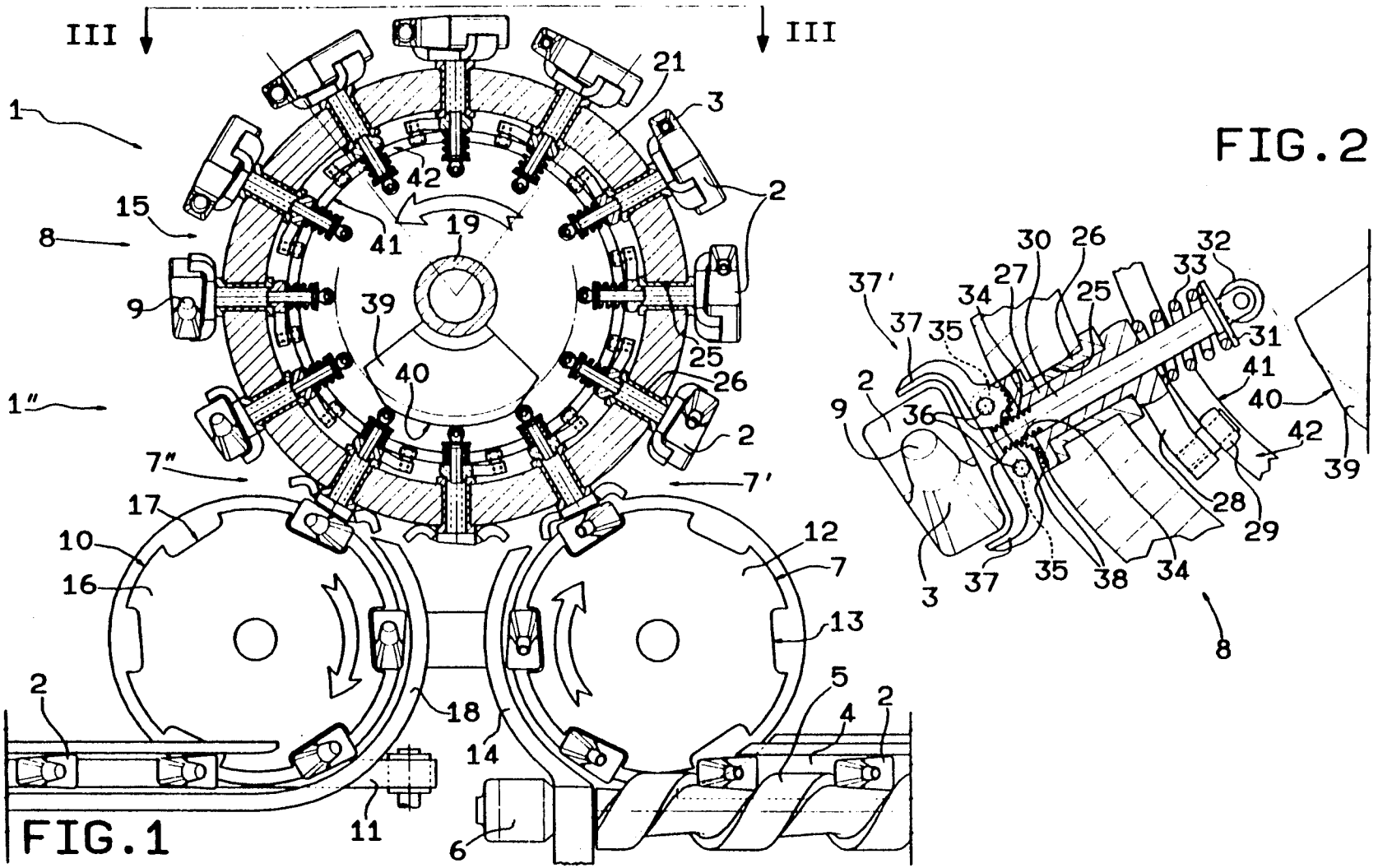
FIG. 1 is a schematic plan view, with parts removed for greater clarity, of a portion of a filling machine which includes an apparatus for applying closures to containers, manufactured according to the present invention.
FIG. 2 is a partially sectional enlarged-scale view of a detail of FIG. 1.

With reference to FIG. 1, the reference numeral 1 generally indicates a filling machine which is only partially illustrated and is suitable for filling with liquid substances and for applying closures to containers 2 which have a mouth 3 which is inclined with respect to an axis of said containers 2.

The machine 1 comprises an apparatus 1' for applying closures to containers, which in turn comprises feeder means which are constituted by a horizontal belt conveyor 4 which is flanked and partially surmounted by a worm or auger conveyor 5 motorized by a motor 6, which is capable of transferring in succession the containers 2 (already filled with liquid by parts of the machine 1 which are not illustrated) toward a rotary conveyor 7 which is adapted for transferring the containers 2 along a circular path.

At an input station 7', the conveyor 7 transfers in succession the containers 2 to a rotary closure application conveyor or closure application carousel 8, which applies closures 9 to the containers 2 and transfers the closure-fitted containers 2, at an output station 7'', to a further rotary output conveyor 10 which transports the containers 2 onto a horizontal belt conveyor 11 which is suitable for sending said containers toward further processing stations which are not illustrated.

The rotary conveyor 7 essentially comprises a drum 12 with a vertical axis, which has a clockwise rotary motion (with reference to FIG. 1) and is provided, on its periphery, with a plurality of mutually equidistant recesses 13, each of which is suitable for accommodating a container 2 which is arranged so that said axis thereof is vertical. The periphery of the drum 12 is flanked by a curved fixed guide 14 which has the purpose of keeping the containers 2 within the recesses 13 during their transfer by means of the conveyor 7.

The closure application carousel 8 comprises (see also FIG. 3) a substantially cylindrical conveyance head 15 which counter-rotates with respect to the conveyor 7 and is substantially tangent thereto.

The rotating conveyor 10 essentially comprises a drum 16 with a vertical axis which rotates clockwise (with reference to FIG. 1) and is provided, on its periphery, with a plurality of mutually equidistant recesses 17, each of which is suitable for accommodating a container 2 which arrives from the closure application carousel 8 and is arranged so that said axis thereof is vertical. The periphery of the drum 16 is flanked by a fixed curved guide 18 which maintains the containers 2 within the recesses 17 during their transfer by means of the conveyor 10.

Figure 3:
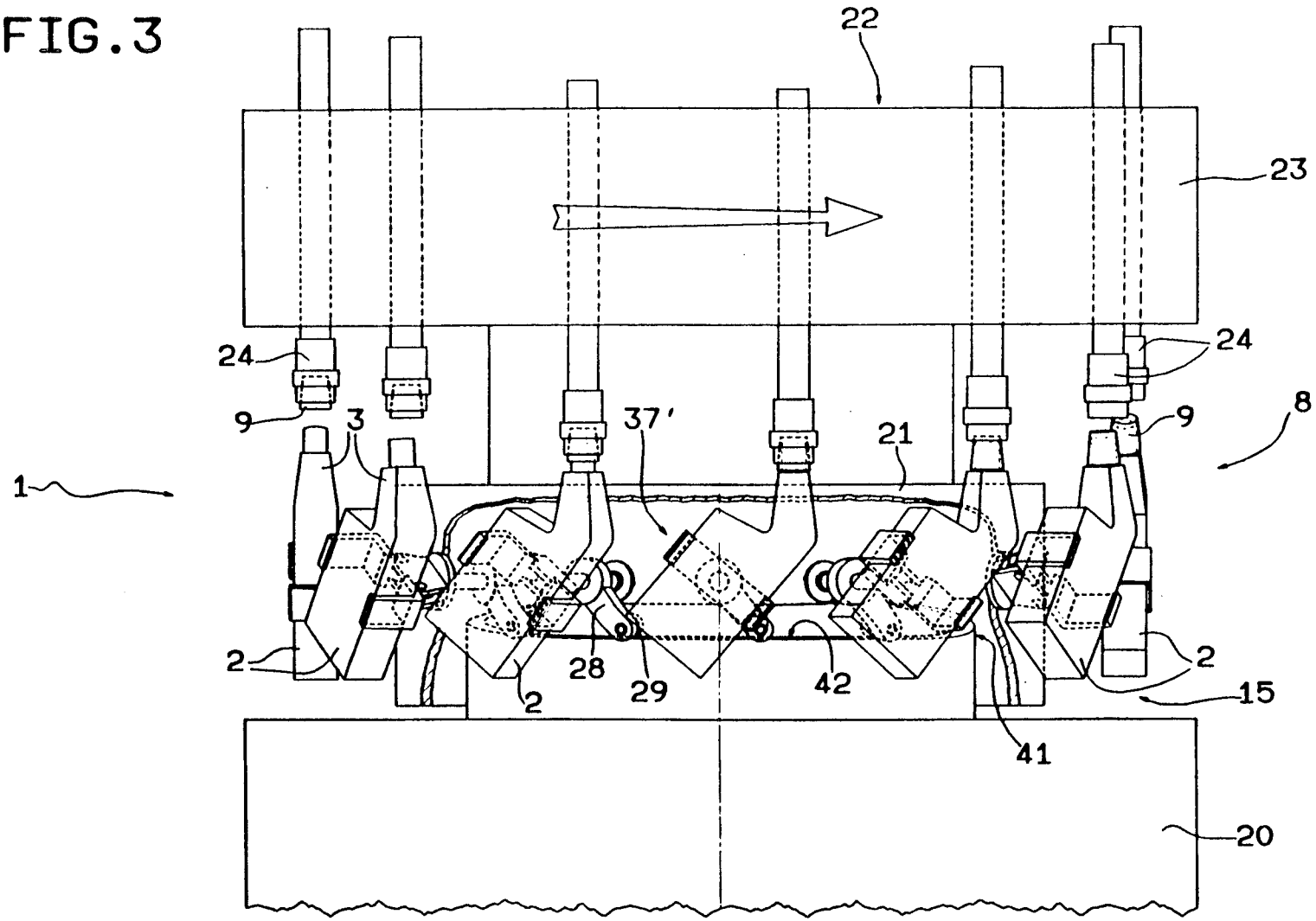
FIG. 3 is a schematic elevation view of the apparatus illustrated in FIG. 1.

According to what is illustrated in particular in FIGS. 1 and 3, the closure application carousel 8 comprises a vertical shaft 19 which is rotatably supported by the base 20 of the machine 1 and is connected, in a manner which is not illustrated, to motor means which are not illustrated.

The shaft 19 supports, in a manner which is not illustrated, a hollow cylindrical body 21 which is coaxial thereto; a known closure application unit 22 is connected to the upper end of said body 21 and is not described in detail hereinafter, since it does not per se constitute the subject of the present invention; said closure application unit essentially comprises a cylindrical body 23 which is coaxial to the shaft 19 and from the lower face of which mutually angularly equidistantly spaced known closure application means or closure application heads 24 extend downward. Each closure application head 24, in order to apply a closure to a container 2, is capable, under the action of actuation means which are not illustrated, of sliding vertically along its own axis and of rotating in both directions about said axis.

According to what is illustrated in particular in FIGS. 1 and 2, the hollow cylindrical body 21 is radially traversed, at a level which is substantially equal to that of a median portion of the containers 2 carried by the conveyor 7, by a plurality of mutually equidistantly spaced holes 25. According to what is illustrated in particular in FIG. 2, each hole 25 is coaxially traversed by a bush 26 inside which a tubular body 27 is rotatably accommodated; an end of a lever 28, which supports a cam-follower roller 29 with its own free end, is connected to said body 27 inside the cylindrical body 21.

A pin 30 is slidingly mounted within each tubular body 27 and supports, at one of its ends which is internal to the hollow cylindrical body 21, a disk 31, which is coaxial thereto and rigidly associated therewith, and a cam-follower roller 32. A helical spring 33 which acts by compression is interposed between the disk 31 and an abutment surface of the tubular body 27, and is wound around a portion of the pin 30. Two racks 34 are defined on the other end of the pin 30 outside the tubular body 27, extend parallel to the axis of said pin 30 and are arranged on opposite sides with respect to said axis.

The end of the tubular body 27 which is external to the hollow cylindrical body 21 supports a tab 35 on which the ends of two substantially L-shaped jaws 37 are pivoted by means of respective pivots 36. Each jaw 37 is provided, proximate to its portion which is engaged in the pivot 36, with a set of teeth 38 which extends along an arc of a circle and engages one of the racks 34. Each pair of mutually adjacent jaws 37 constitutes what will be referred to hereinafter as a clamp or grip means 37'.

The base 20 of the machine 1 supports, coaxially to the shaft 19 and inside the hollow cylindrical body 21, a fixed cam 39 which has a lateral track 40, which is suitable for being engaged by the rollers 32, and a fixed cam 41, an upper track whereof 42 is followed by the rollers 29.

The cam-follower rollers 29 and the cam 41 are also termed, hereinafter, actuation means of the grip means 37', since they can impart to said grip means 37' an oscillation in both directions between a first position and a second position, at which said axes of the related containers 2 and, respectively, the axes of the mouths 3 of said containers 2 are arranged substantially vertical.

In use, the containers 2 to which the closure is to be applied, filled with liquid and arranged vertically, are guided in succession by the belt conveyor 4 and by the scroll conveyor 5 into respective recesses 13 of the rotary conveyor 7.

Said conveyor 7 then sends the containers 2 in succession between the jaws 37 of respective clamps 37' of the closure application unit 22; each clamp firmly grips a container 2, in a manner which is clearly illustrated in FIG. 2, by virtue of the action of the cam 39 on the related roller 32 and of said meshing between the racks 34 and the sets of teeth 38.

During this gripping action, each clamp 37' is kept, by virtue of the action of the cam 41 on the roller 29, in such as position as to allow the accommodation of a vertically arranged container 2.

After the arrival of each container 2 between the jaws 37 of a clamp 37' at the input station 7', as the closure application carousel 8 continues to rotate, the cam 41 produces a rotation of each clamp 37, about the axis of the pin 30 which is such as to incline the related container 2 and arrange it so that the axis of its mouth 3 is vertical. The axis of the pin 30, about which said rotation occurs, is substantially radial with respect to the closure application carousel 8.

With the containers 2 arranged in this manner, the closure application heads 24 apply the closures 9 to the underlying mouths 3 and, at the end of each closure application operation, the cam 41 causes a rotation of each clamp 37' about the axis of the related pin 30 which is such as to return the related container 2 to the original vertical position before it reaches the output station 7''. At said output station 7'', each clamp 37' opens and transfers the related closure-fitted container 2 to a recess 17 of the output conveyor 10, which in turn transfers the containers 2 to the belt conveyor 11.

From what has been described, it is evident that the described apparatus is capable of applying closures 9 to containers 2 having a neck which is inclined with respect to the vertical without having the disadvantages described with reference to the known art.

The described rotation of the containers 2 supported by the clamps 37' in fact occurs more slowly than in known devices, and the transfer of the containers 2 from the rotary conveyor 7 to the closure application carousel 8 occurs in a particularly easy manner.

There are naturally many variations which, without altering the concept of the invention, could be applied to the described apparatus 1' without abandoning the scope of the present invention.

In particular, for example, the conveyors 7 and 10 and the conveyance head 15 may be replaced with linear conveyors which are capable of transferring containers 2 to one other in a manner similar to the one described.

The described movements of the grip means 37' may furthermore be produced by actuation means of any type, different from those examined, and said grip means 37' may be made in a different manner from the one described.

We claim:

1. Apparatus for applying closures to containers which have a mouth which is inclined with respect to an axis of said containers, comprising first conveyance means and second conveyance means for transferring in succession said containers arranged so that said axes thereof are vertical, and a closure application conveyor adapted for receiving said containers from said first conveyance means and for transferring them to said second conveyance means; said closure application conveyor comprising means for gripping the containers arriving from said first conveyance means, and actuation means for imparting to said grip means an oscillation in both directions between a first position and a second position at which said axes of the related containers and, respectively, the axes of the mouths of said containers are arranged substantially vertical; the closure application conveyor comprising closure application means adapted for applying said related closures to said containers while the axes of the mouths of said containers are arranged substantially vertical.

2. Apparatus according claim 1, wherein said closure application conveyor is constituted by a rotating carousel supporting a plurality of said grip means which are mutually equidistant and each of which is capable of oscillating about a respective axis which is substantially radial with respect to said carousel, said actuation means comprising cam means which engage cam-follower means which are associated with said grip means.

* * * * *